US006629788B2

(12) United States Patent
Miranda et al.

(10) Patent No.: US 6,629,788 B2
(45) Date of Patent: Oct. 7, 2003

(54) METHOD AND APPARATUS FOR CLAMPING AND ADJUSTING AN ANTI-ROTATION RAIL TO ADJUST PRINTHEAD TO PLATEN/MEDIA SPACING IN A PRINTER

(75) Inventors: Mark Miranda, Vancouver, WA (US); Shawn M. Close, Vancouver, WA (US); Carol Chia-Sheng Hsu, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 99 days.

(21) Appl. No.: 10/015,918

(22) Filed: Oct. 30, 2001

(65) Prior Publication Data

US 2003/0081972 A1 May 1, 2003

(51) Int. Cl.[7] ..... B41J 25/208

(52) U.S. Cl. ..... 400/59; 400/354; 400/703; 400/55; 347/8

(58) Field of Search ..... 400/55, 56, 59, 400/60, 352, 354, 703; 347/8

(56) References Cited

U.S. PATENT DOCUMENTS 5,065,169 A 11/1991 Vincent et al.
5,078,517 A * 1/1992 Hiroshi et al. ..... 400/59
5,468,076 A * 11/1995 Hirano et al. ..... 400/59
5,692,842 A * 12/1997 Sasai et al. ..... 400/59
5,975,778 A * 11/1999 Kanemitsu ..... 400/352
6,406,110 B1 * 6/2002 Ahne et al. ..... 347/8
6,450,710 B1 * 9/2002 Foster et al. ..... 400/58
6,524,021 B2 * 2/2003 Johnson et al. ..... 400/354
6,561,606 B1 * 5/2003 Yoshida ..... 347/8
6,575,543 B2 * 6/2003 Ahn ..... 347/8

* cited by examiner

*Primary Examiner*—Andrew H. Hirshfeld
*Assistant Examiner*—Dave A. Ghatt

(57) ABSTRACT

Apparatus and method for adjusting and maintaining printhead-to-platen spacing in a printing device, wherein the printing device includes a printhead-carrying carriage and the carriage is pivotally mounted on and reciprocally shiftable along a guide shaft. An anti-rotation rail mounted on a hanger in the printer engages the carriage and determines its position relative to the printer's platen. A clamp structure is connected to the anti-rotation rail and extends through the hanger and is operable for clamping the anti-rotation rail to the hanger. An adjuster mechanism connected to the clamp structure is operable for selectively shifting the anti-rotation rail vertically upwardly or downwardly to position and maintain the carriage, and correspondingly, the printhead a preselected, nominal distance from the platen.

17 Claims, 3 Drawing Sheets

METHOD AND APPARATUS FOR CLAMPING AND ADJUSTING AN ANTI-ROTATION RAIL TO ADJUST PRINTHEAD TO PLATEN/MEDIA SPACING IN A PRINTER

TECHNICAL FIELD

The present invention relates to printers, and more particularly, to a method and apparatus for adjusting the anti-rotation rail in a printer to thereby adjust the printhead-carrying carriage relative to the platen in a printer which correspondingly adjusts the printhead-to-platen spacing.

BACKGROUND OF THE INVENTION

Inkjet printers typically include a carriage which holds printheads for ejecting ink onto media as the carriage reciprocates along a guide shaft above a platen. The platen provides a surface along which media, such as single-sheet paper or envelopes, are carried.

Conventional inkjet printers include a bearing rail, called an "anti-rotation rail," which is mounted on a hanger in the printer, along which an arm of the carriage slides, as the carriage reciprocates along the guide shaft during a printing operation. The anti-rotation rail can be adjusted and fixed, to pivot the carriage, and correspondingly the printhead, relative to the guide shaft, which in turn sets the printhead-to-platen spacing. In the manufacture of printers, it is desirable to pre-set and fix the printhead-to-platen spacing to some nominal distance to ensure optimum print quality. A common practice is to use a measurement tool, such as a linear variable differential transducer (LVDT), by inserting it into the receptacle on a carriage which carries a printhead.

The tool includes a probe which extends downwardly and engages the platen, and a readout informs production or line personnel of the printhead-to-platen spacing. The practice heretofore has been to adjust the anti-rotation rail, which then adjusts the carriage and the printhead-to-platen spacing, to fix that spacing at some nominal amount, say 1.4 mm. This adjusting step is done with a pair of screws mounted on the anti-rotation rail, positioning of these screws being necessary to adjust the anti-rotation rail to a predetermined setting. The next step requires that additional screws, not part of the adjusting process, be used to fix the anti-rotation rail to the hanger. This method has several drawbacks, the first being that line personnel have difficulty keeping track of the multiple screws which can be misplaced. Importantly, a problem resides in the fixing of the anti-rotation rail, after adjustment, because the fixing or tightening can vary an adjustment which has just been made. Thus, the nominal spacing, as a printer unit leaves, may not be achieved. If screws are not properly affixed, vibration during shipping and handling can vary the printhead-to-platen spacing.

SUMMARY OF THE INVENTION

The present invention provides apparatus for adjusting and maintaining printhead-to-platen spacing in a printer, and a method for achieving the adjustment which contemplates that the anti-rotation rail is first clamped or fixed to the hanger, followed by the adjusting step where the nominal printhead-to-platen spacing is set. This is accomplished by using a combination clamp structure/adjuster mechanism in which the anti-rotation rail is first clamped to the hanger, and the adjuster mechanism, which includes a rotatable member, is operable for selectively shifting the anti-rotation rail vertically upwardly or downwardly to position and maintain the carriage, and correspondingly, the printhead at a preselected distance from the platen.

The clamp structure typically includes a pin member, such as a screw, which extends through the anti-rotation rail and engages a rotatable member operable for rotation to urge the pin member against the anti-rotation rail to shift the rail to a desired position. In the depicted embodiment, there are two clamp structure/adjuster mechanisms provided, one adjacent each end of the anti-rotation rail. The lateral spacing of the mechanisms ensures that during a production process, line personnel may efficiently and accurately pre-set nominal printhead-to-platen spacing at opposed ends of the carriage travel, thereby ensuring that any offset in the platen will be taken into account.

DETAILED DESCRIPTION OF THE PREFERRED EMBODIMENT AND BEST MODE OF CARRYING OUT THE INVENTION

As mentioned at the outset, the present invention is directed to an apparatus and method for enabling the adjustment and maintenance of the printhead-to-platen spacing in a printer, and in particular, the apparatus and method are provided for adjusting this spacing during the production process. While the apparatus and method can be utilized for adjusting the printhead-to-platen spacing after a printer has been assembled, the present invention contemplates that providing nominal printhead-to-platen spacing during the production process is important. That is because when a produced printer unit is shipped, it is done so with a pre-set, nominal printhead-to-platen spacing to ensure optimum print quality. Moreover, the pre-set spacing provided here can withstand normal shipping vibrations and relatively minor drop events, with the nominal spacing being maintained.

The apparatus and method of the present invention contemplates for the first time, it is believed, that an anti-rotation rail will first be clamped, or relatively rigidly fixed to a hanger in a printer, after which time the anti-rotation rail is adjusted, to enable the carriage to be pivoted, about its guide shaft, so that a predetermined printhead-to-platen spacing is achieved. The apparatus for clamping and adjusting includes a combined clamp structure/adjuster mechanism in which the adjuster mechanisms are located at laterally spaced-apart locations on the anti-rotation rail.

The clamping is accomplished by providing tab members, at the laterally spaced-apart positions, which receive a pin member extending therethrough and for extension through the hanger. The adjustable mechanism includes a rotatable member which is connected to the pin member, so that rotation moves the anti-rotation rail either upwardly or downwardly. This is accomplished by the rotatable member receiving the pin member at a position offset from the central or rotational axis of the rotatable member. Therefore, upon rotation, the pin member engages the tab member, and being offset, moves it upwardly or downwardly, substantially vertically, depending on the direction of rotation. The application of this clamp structure/adjuster mechanism will be appreciated from the following detailed description.

Figure 1:
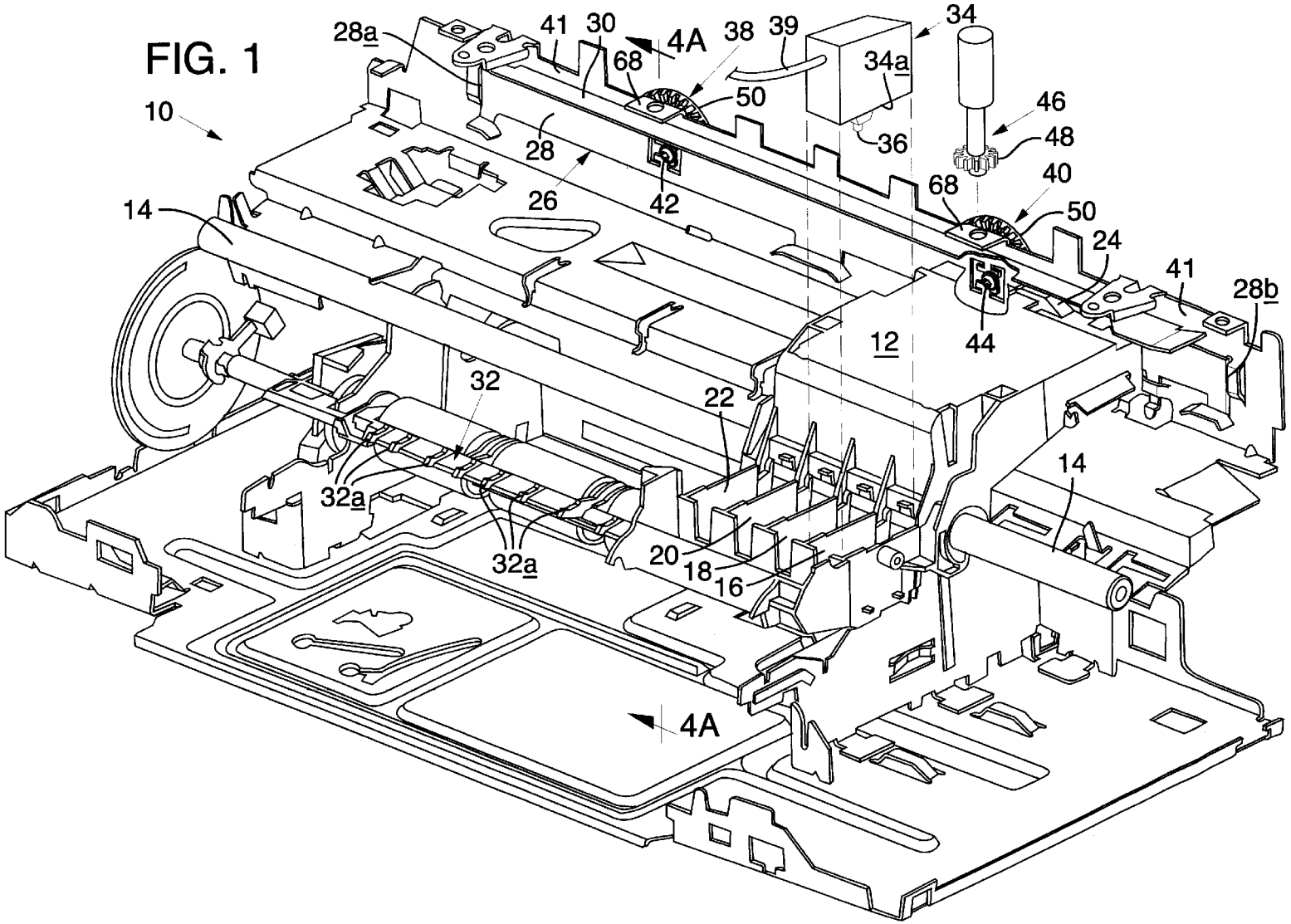
FIG. 1 is an isometric view of a printer, with its cover panels and printheads removed, illustrating an anti-rotation rail equipped with the clamp structure/adjuster mechanism of one embodiment of the present invention, and wherein a measurement tool is shown positioned above the carriage for insertion into one of the printhead-carrying cells of the carriage, as would occur during the manufacturing process.

As shown in FIG. 1, a printer is generally indicated at 10, with its cover panels removed and other components not shown, as it might appear at some stage during production. A carriage is generally indicated at 12, laterally shiftable along a guide shaft 14, in a conventional manner. The carriage includes a plurality of cells or receptacles, four in number here, such as indicated at 16–22. Each of the cells will eventually receive a print cartridge, which includes a printhead with nozzles for activation in a printing process. The printer shown in FIG. 1 is a larger model, having multiple printhead-receiving cells. The carriage includes a slider 24 which is configured to slide along the bottom of a flange of an anti-rotation rail as will be described.

As shown in FIG. 1, an anti-rotation rail is generally indicated at 26, and includes an elongate plate with opposed ends 28*a* and 28*b*. Formed as a top portion of anti-rotation rail 26 is a flange 30 typically bent at a right angle to plate 28. It is along the bottom of this flange that slider 24 slides, as carriage 12 is reciprocated along guide shaft 14. A platens 32, with corresponding ribs 32*a*, will support media, whether single sheets or envelopes, as they pass beneath the printhead carrying portion of carriage 12, in the completed unit.

The anti-rotation rail, which is adjustable in a manner to be described, orients carriage 12, by enabling it to be rocked to a preselected position on guide shaft 14, so that a preselected printhead-to-platen spacing can be provided, either during the production process or subsequent. As also shown in FIG. 1, a test instrument, generally indicated at 34, which may be a linear variable differential transducer (LVDT) includes a probe 36 and a connection 39 to a conventional readout (not shown). Transducer 34 is shown positioned above cell 16 prior to insertion thereinto, for determining printhead-to-platen spacing, in a manner to be described. The bottom, indicated at 34*a*, of the transducer corresponds generally to the bottom surface of the printhead cartridge, when the transducer is positioned within a cell in the carriage.

A pair of laterally spaced-apart adjusting mechanisms, generally indicated at 38 and 40, are mounted on the backside of a hanger structure 41 of the printer. The adjuster mechanisms are mounted for interconnecting the hanger to anti-rotation rail 26 by pin members 42 and 44, respectively, in a manner to be described. Still viewing FIG. 1, there is shown an actuator, generally indicated at 46 which includes a pinion 48 for rotatably driving the adjuster mechanisms 38, 40 in a manner to be described.

Figure 2:
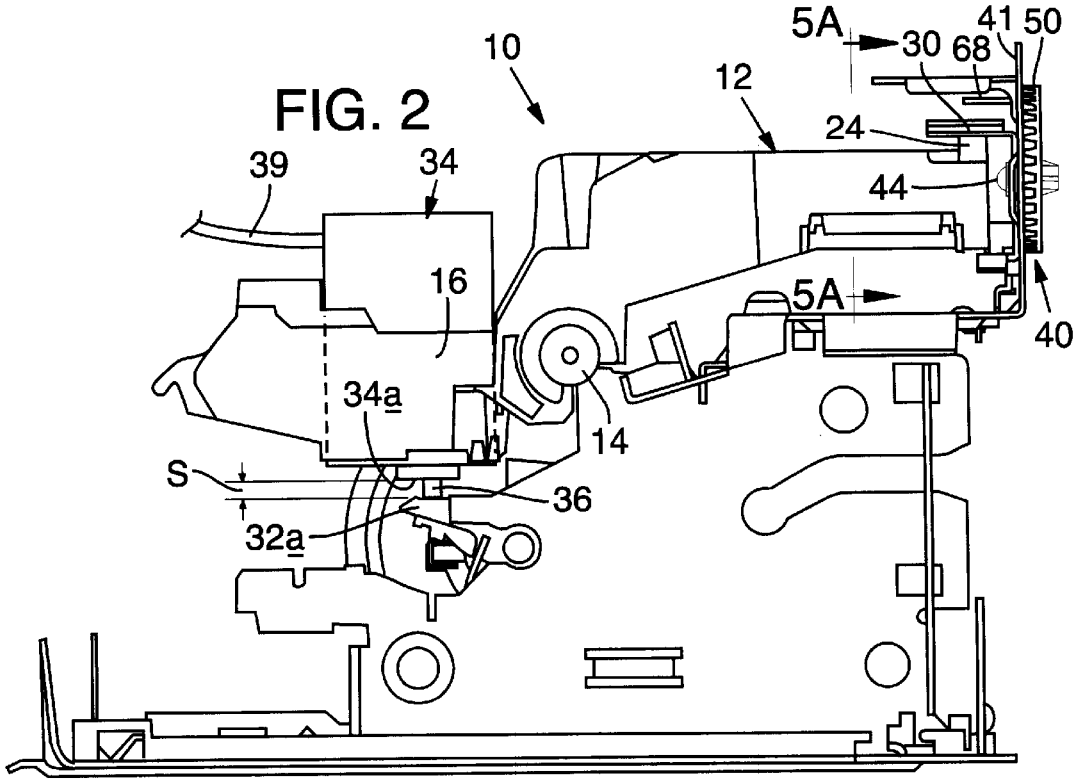
FIG. 2 is an end view of the printer of FIG. 1 and illustrates mounting of the measurement tool in the carriage so that a probe engages a platen so that printhead-to-platen spacing can be determined, as would occur in the manufacturing process.

FIG. 2 is a view showing transducer 34 inserted into a cell, such as cell 16 of the printer so that probe 36 engages a rib 32*a*. The distance S, as shown, represents the printhead-to-platen spacing which will be pre-set, as described hereinafter to a nominal setting. A bottom 34*a* of the test unit corresponds generally to the bottom surface of the printhead cartridge. As shown in FIG. 2, slider 24 of carriage 12 engages the underside of flange 30 of the anti-rotation rail, and adjuster mechanism 40 is mounted to hanger structure 41 by means of pin member 44. At this point, discussion will now be focused on the construction of the adjuster mechanisms and clamp structure, with specific reference to adjuster mechanism 38 and pin member 42, it being understood that adjuster mechanism 40 and pin member 44 are constructed identically.

Figure 3:
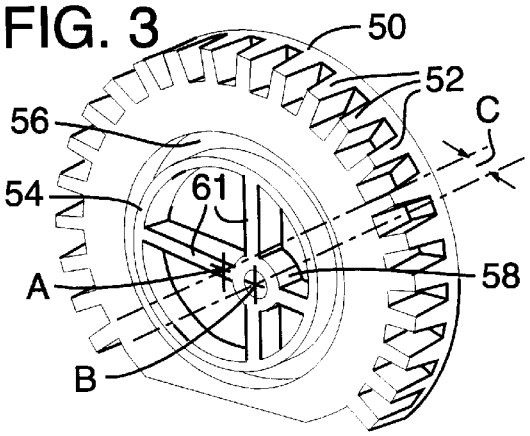
FIG. 3 is an enlarged view of the rotatable member of the adjuster mechanism, shown isolated from other structure.

As shown in FIG. 3, adjuster mechanism 38 includes a rotatable member 50 which is formed as a ring gear having a plurality of teeth 52. The rotatable member is formed with a cylindrical boss 54 seated within a concentric, cylindrical recess 56. The rotational axis of rotatable member 50 is indicated at A, and offset from that axis is a cylindrical interior boss 58 whose axis is indicated at B, with stiffening elements shown at 61. As shown in FIG. 3, axis B is offset from rotational axis A by the distance indicated at C.

Figure 4A:
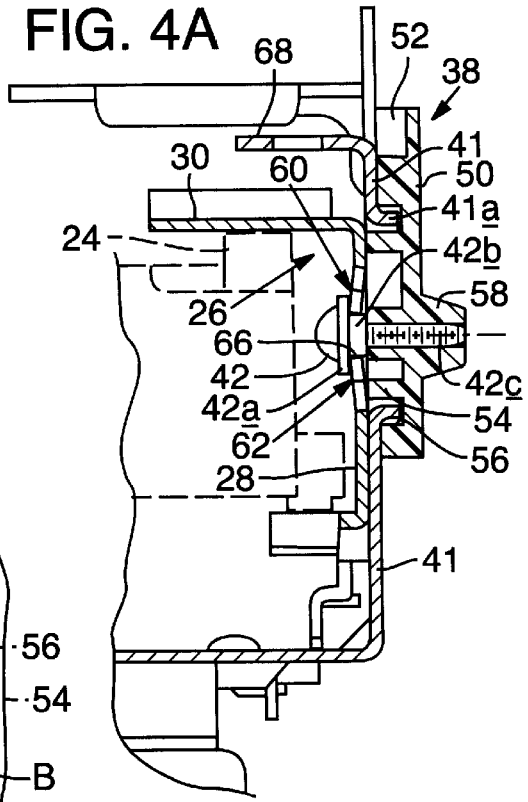
FIG. 4A is a cross-sectional view taken along lines 4A—4A of FIG. 1, and shows relationship of the anti-rotation rail and the adjuster mechanism as they are mounted on the hanger of the printer.
Figure 4:
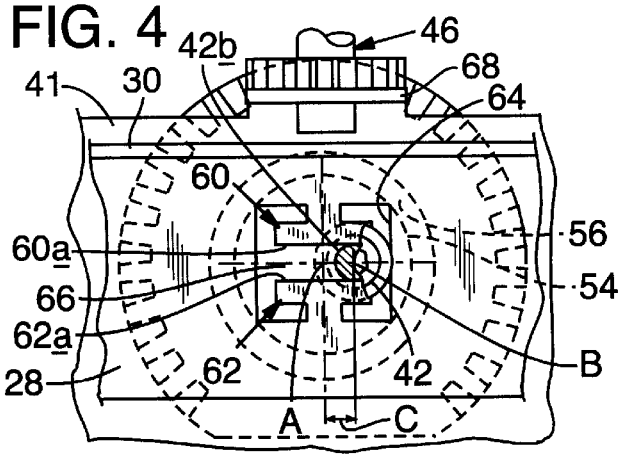
FIG. 4 is a view, looking directly inwardly into the left adjuster mechanism of FIG. 1.

Rotatable member 50, as shown in FIG. 4, is mounted to hanger structure 41 and anti-rotation rail 26 by means of a clamp structure, comprising pin member 42, and a pair of opposed, outwardly flexed tab members, indicated at 60 and 62, which are T-shaped in form and extend from an aperture 64 formed in the anti-rotation rail in a punch process or the like. A portion of pin member 42, is broken away, to show shoulder 42*b*, which engages the tab members.

The tab members are opposed to one another, and each includes a rectilinear edge, such as indicated at 60*a* which faces a rectilinear edge 62*a* of the opposed tab member. The rectilinear edges are parallel and spaced apart to define a slot 66 which is dimensioned to receive and seat pin member 42. As shown in FIG. 4A, pin member 42, which may take the form of a hex-head socket screw, includes a washer 42*a* and shoulder 42*b* from which extends a self-tapping, threaded shank 42*c*. FIG. 4A shows how tab members 60, 62 are flexed outwardly, to provide spring tension, and how shoulder 42*b* is dimensioned so that when pin member 42 is inserted through the slot, shoulder 42*b* engages the tab members, and specifically, engages rectilinear edges 60*a* and 62*a*.

Rotatable member 50 is rotatably journaled on hanger 41 by mounting it so that well 56 and boss 54 are rotatably journaled around a cylindrical rim 41*a* which has been bent outwardly from the anti-rotation rail. Thus, because rectilinear edges 60*a* and 62*a* are parallel to one another, and vertically spaced apart, rotation of rotatable member 50 moves pin member 42 along an arcuate path, with shoulder 42*b* engaging one of the rectilinear edges, depending upon rotational direction, to shift the anti-rotation rail vertically upwardly or downwardly. The distance the anti-rotation rail can be shifted upwardly or downwardly is substantially equal to the offset distance C, defined as the spacing between rotational axis A and offset axis B of pin member 42.

As mentioned previously, tab members 60 and 62 are formed in anti-rotation rail 26 so that they are normally biased or flexed outwardly from the surface of the anti-rotation rail, thereby providing a spring force or tension against which pin member 42 is urged when the pin member is secured to rotatable member 50. As shown in FIG. 4A, when the pin member has been sufficiently extended into boss 58, the tab members are flexed inwardly as shoulder 42*b* seats against the inside surface of boss 58. Thus, pin member 42 clamps rotatable member 50 in position, depending upon the degree of insertion of pin member 42 into boss 58.

Stated differently, the greater that pin member 42 is threadedly driven inward to boss 58, the greater the resisting spring force of the tab members and the greater the clamping force. It is to be understood, however, that the clamping force created by the clamping structure as described, is sufficient to normally maintain position of the anti-rotation rail, but still accommodate rotation of rotatable member 50. Thus, the rotatable member can urge or shift the anti-rotation rail either upwardly or downwardly, in a substantially vertical direction, even though the anti-rotation rail is clamped to hanger structure 41.

Establishing Nominal Printhead-to-Platen Spacing During Manufacture of a Printer The method for nominally pre-setting and maintaining the printhead-to-platen spacing in a printer during manufacturing, using the present invention, proceeds generally along the following lines. It is emphasized that the method of the present invention, using the apparatus as described above, contemplates that the anti-rotation rail is first clamped to the hanger structure and then, using the adjuster mechanism of the present invention and a hand-held tool, adjustment takes place to provide the nominal spacing.

Conventionally, in printers using an anti-rotation rail, the rail is suitably adjusted, along its hanger structure, so that the carriage is rocked on the guide shaft to pre-set the nominal spacing, using a measurement tool, such as a linear variable differential transducer (LVDT). Typically the carriage is positioned first at one end of the guide shaft where a printhead to platen measurement is set, and then shifted to the other end of the carriage where another measurement is taken and the anti-rotation rail set to fix the printhead-to-platen spacing at that end. After the anti-rotation rail has been adjusted, it is then clamped to the hanger structure.

In contrast, in the present embodiment of the invention, the clamping step takes place first and then the adjustment step, using the novel clamp structure/adjuster mechanism described here. Specifically, it will be assumed that anti-rotation rail 26 has already been clamped onto hanger structure 41, where pin members 42 and 44 are seated against their respective rotatable members. Carriage 12 is shifted along the guide shift to one end of the platen, such as to the right end as shown in FIG. 1. Measuring tool 34 is then positioned in a printhead cell of the carriage, such as cell 16, and a measurement of the printhead-to-platen spacing is then sensed by probe 36 and recorded. Depending on what that measurement is, an adjustment may have to be made. That is where tool 46 is employed. As shown in FIG. 1, the tool is positioned above an apertured ledge 68 and extended downwardly until pinion 48 meshes with the rings of the rotatable member. Rotation of the hand-held tool can then be used to shift the right side of that anti-rotation rail either upwardly or downwardly until the nominal spacing is achieved, say a spacing of 1.4 mm.

Figure 5A:
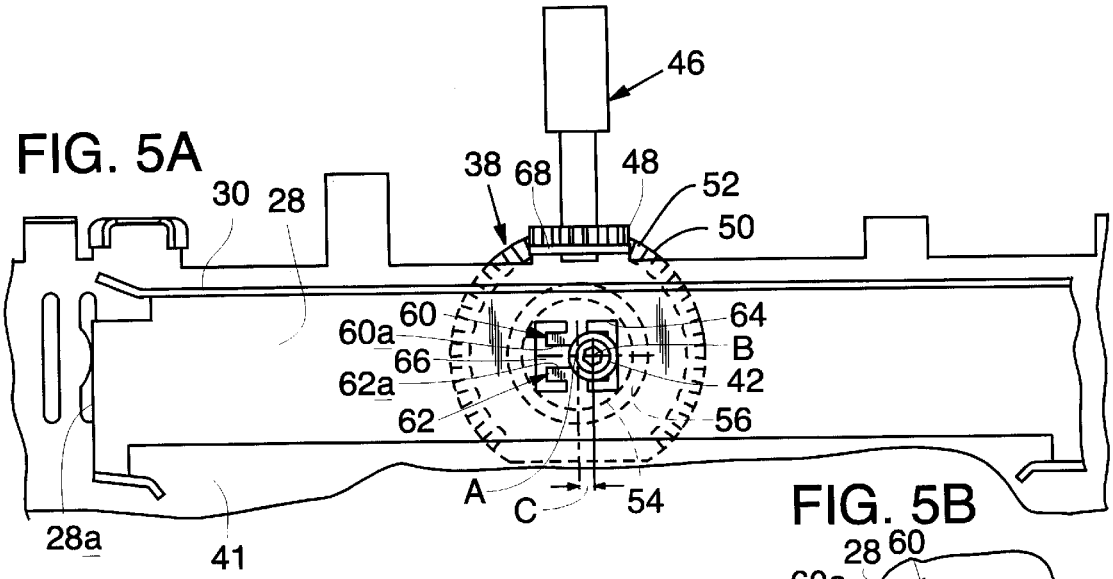
FIG. 5A is a view taken along 5A—5A of FIG. 2, and shows the left adjuster mechanism, viewing FIG. 1, when it is in its neutral position.
Figure 5B:
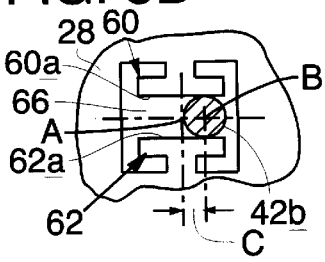
FIG. 5B is an enlarged view, with portions cut away, of the flexible tab members of the anti-rotation rail and orientation of the shoulder of the pin member as it engages the tab members in the neutral position.

These steps may be further appreciated from a consideration of FIGS. 5A, 5B, 6A, 6B and 7A, 7B. It will now be assumed that carriage 12 has been shifted along guide shaft 14 to the left and the cells of the carriage are positioned over the left side of the platen structure. As shown in FIGS. 5A and 5B, pin member 42 is in its neutral position, i.e. as shown in FIG. 5A, shoulder 42*b* engages the tab members but rotatable member 50 has not been rotated. Depending upon the degree to which the left end of anti-rotation rail 26 must be raised or lowered, to achieve the desired 1.4 mm spacing, tool 46 will be rotated either clockwise or counterclockwise to shift the anti-rotation rail vertically either upwardly or downwardly.

Figure 6A:
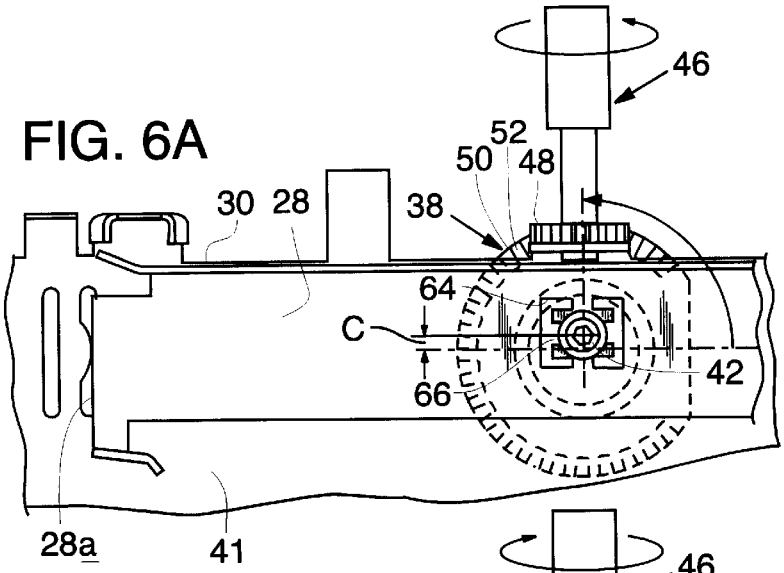
FIG. 6A is a view similar to FIG. 5A, showing the adjuster mechanism rotated so that the pin member and shoulder have moved vertically upwardly to shift the anti-rotation rail vertically upwardly.
Figure 6B:
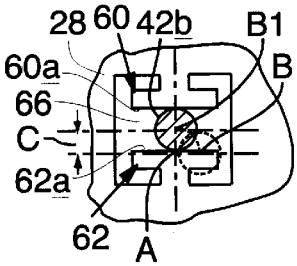
FIG. 6B is a view similar to FIG. 5B, showing the pin member and shoulder as they have rotated upwardly by the adjuster mechanism.

As shown in FIG. 6A, it is assumed that to achieve the proper spacing, the anti-rotation rail must be raised vertically, and in this case we are assuming that the maximum vertical shifting must take place. Production line personnel mount tool 46 so that pinion 48 engages the teeth of rotatable member 50, and the tool is rotated counterclockwise, as shown, so that rotatable member 50 also rotates counterclockwise about its rotational axis A. However, because pin member 42 is offset a distance C from axis A, the pin member rotates along an arcuate path and shoulder 42*b* engages rectilinear edge of tab member 60 and urges anti-rotation rail 26 upwardly, as shown in FIG. 6B, so that the center of pin member 41 is now shown at B1. The maximum distance that the anti-rotation rail can move upwardly is represented by C, the offset of the center of pin member 42 relative to rotational axis A.

Figure 7A:
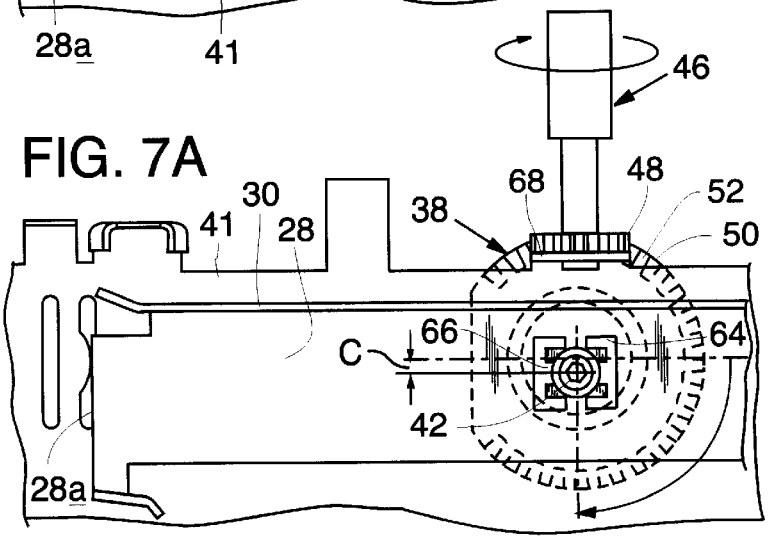
FIG. 7A is a view similar to FIGS. 5A and 6A, showing the adjuster mechanism having been rotated from the neutral position to its lowermost position so that the anti-rotation rail is moved vertically downwardly to its lowermost position.
Figure 7B:
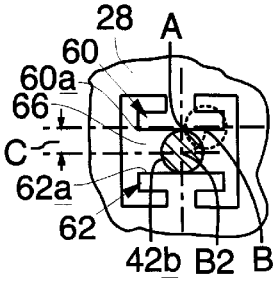
FIG. 7B is a view similar to FIGS. 5B and 6B, showing position of the pin member, and the shoulder as it is moved by the adjuster mechanism to shift the anti-rotation rail to its lowermost position.

FIGS. 7A and 7B show the anti-rotation rail moved a maximum distance C downwardly from its neutral position shown in FIG. 5A. Tool 46 has been rotated in a clockwise direction, so that rotatable member 50 is also rotated clockwise and shoulder 42*b* of pin member 42 engages rectilinear edge 62*a* of tab member 62 and moves it downwardly so that the vertical distance which anti-rotation rail 26 moves is indicated at C. The center of pin member 42 is now displaced to B2.

INDUSTRIAL APPLICABILITY

The present invention finds particular applicability to establishing printhead-to-platen spacing during the manufacturing process of printers which incorporate printhead-carrying carriages and which are pivotal on a guide shaft. The present invention sets forth a very simple apparatus and method utilizing a clamping structure and adjuster mechanism which enables printhead-to-platen spacing to be quickly and accurately pre-set. The apparatus and method of the invention are based upon first clamping the anti-rotation rail and then adjusting that rail so that the pivotal relation of the carriage to the platen can be accurately set by the adjuster mechanisms. In contrast to conventional processes which first adjust and then clamp the anti-rotation rail, the present invention clamps first and then adjusts.

This ensures that the clamping step does not override a nominal printhead to platen adjustment previously made.

Adjustments using the apparatus of the present invention are readily implemented by production line personnel and the resultant clamped, adjusted arrangement helps ensure that the nominal spacing is maintained during normal shipping and handling. Because only two pin members or screws are used, and they are required to clamp and are incorporated in the adjustment process, it is less likely that line personnel will neglect placement of the screws because that must be done before the adjustment process can take place. In prior systems, when adjustment took place initially, clamping screws could inadvertently be left off.

We claim:

1. Apparatus for adjusting and maintaining printhead-to-platen spacing in a printing device, wherein the printing device includes a carriage for holding printhead, the carriage pivotally mounted on and reciprocally shiftable along a guide shaft, and wherein an anti-rotation rail disposed adjacent a hanger in the printing device engages the carriage to determine its position relative to a platen, the apparatus comprising:

clamp structure connected to the anti-rotation rail and extending through the hanger operable for clamping the anti-rotation rail to the hanger; and adjuster mechanism rotatably connected to the clamp structure operable for selectively shifting the anti-rotation rail vertically upwardly or downwardly, while the anti-rotation rail is still clamped to the hanger structure to position and maintain the carriage, and correspondingly, the printhead a preselected distance from the platen.

2. The apparatus of claim 1 wherein the clamp structure includes a pin member, and wherein the adjuster mechanism includes a rotatable member operable for rotation to urge the pin member against the anti-rotation rail to shift the rail upwardly or downwardly.

3. The apparatus of claim 2 wherein the rotatable member is journaled to the hanger and rotatable about a central, rotational axis, the pin member being connected to the rotatable member offset from the rotational axis.

4. The apparatus of claim 3 wherein the anti-rotation rail includes an aperture from which extend a pair of tab members normally biased outwardly from the surface of the anti-rotation rail, the tab members opposed from one another and defining a slot therebetween.

5. The apparatus of claim 4 wherein the pin member is dimensioned for insertion into the slot and for seating against the tab members.

6. The apparatus of claim 5 wherein the pin member is selectively movable for exerting a force against the tab members when the pin member is secured to the rotatable member.

7. The apparatus of claim 6 wherein the pin member is a threaded member, threadably engaged within a receiving boss provided in the rotatable member.

8. The apparatus of claim 7 wherein the pin member includes a shoulder for engaging the tab members, and wherein each tab member includes an element opposed from the other to define the slot.

9. The apparatus of claim 4 wherein each tab member includes a rectilinear edge facing the rectilinear edge of the opposed tab member, the rectilinear edges being spaced-apart to define the slot, and wherein the pin member is inserted through the slot and includes a shoulder engageable with the rectilinear edges.

10. The apparatus of claim 9 wherein the rectilinear edges are parallel to one another and vertically spaced-apart, so that rotation of the rotatable member moves the pin member along an arcuate path to enable the shoulder to engage one of the rectilinear edges, depending upon rotational direction, to shift the anti-rotation rail upwardly or downwardly.

11. The apparatus of claim 10 wherein the rotatable member includes a ring gear, the rotatable member being arranged on the hanger for engagement with a detachable hand-held tool having gear teeth operable for selectively driving the rotatable member in a selected rotational direction.

12. The apparatus of claim 11 wherein the hanger includes a mount for receiving the hand-held tool so that gear teeth of the tool can be aligned to mesh with gear teeth of the rotatable member.

13. A method for nominally pre-setting and maintaining printhead-to-platen spacing in a printing device comprising:

clamping an anti-rotation rail to a hanger in the printing device;

positioning a test instrument in a carriage of the printing device to determine a distance between a nozzle surface of the printhead and a platen of the printing device; and adjusting the anti-rotation rail to position the carriage to provide a preselected nominal printhead-to-platen spacing.

14. The method of claim 13 wherein clamping includes extending a pin member through the anti-rotation rail and connecting the pin member and drawing it closer to an adjuster mechanism positioned on the hanger to urge the anti-rotation rail against the hanger.

15. The method of claim 14 wherein clamping further includes urging the pin member against a flexed portion of the anti-rotation rail.

16. The method of claim 15 wherein clamping and adjusting are performed at spaced-apart locations on the anti-rotation rail.

17. The method of claim 16 wherein adjusting further includes rotating a rotatable member connected to the pin member for urging the pin member against the anti-rotation rail to shift the anti-rotation rail substantially upwardly or downwardly, depending upon the direction of rotation of the rotatable member.

* * * * *